US008059854B2

(12) United States Patent
Wu

(10) Patent No.: US 8,059,854 B2
(45) Date of Patent: Nov. 15, 2011

(54) EARPHONE

(75) Inventor: Yen-Shuh Wu, Taichung (TW)

(73) Assignee: Merry Electronics Co., Ltd., Taichung (TW)

( * ) Notice: Subject to any disclaimer, the term of this patent is extended or adjusted under 35 U.S.C. 154(b) by 857 days.

(21) Appl. No.: 12/118,743

(22) Filed: May 11, 2008

(65) Prior Publication Data

US 2009/0279731 A1 Nov. 12, 2009

(51) Int. Cl.
*H04R 1/10* (2006.01)

(52) U.S. Cl. ..... 381/386; 455/351

(58) Field of Classification Search ..... 381/370, 381/371, 375, 384

See application file for complete search history.

(56) References Cited

U.S. PATENT DOCUMENTS

| | | | | |
|---|---|---|---|---|
| 3,798,389 | A * | 3/1974 | Tokizaki | 381/370 |
| 5,339,461 | A * | 8/1994 | Luplow | 455/351 |
| 5,832,098 | A * | 11/1998 | Chen | 381/370 |
| 6,434,249 | B1 * | 8/2002 | Wei | 381/370 |
| 6,480,611 | B2 * | 11/2002 | Hashimoto et al. | 381/371 |

* cited by examiner

*Primary Examiner* — Roy Potter

(74) *Attorney, Agent, or Firm* — Chun-Ming Shih

(57) ABSTRACT

An earphone includes a housing, a reel mechanism, a speaker, and a transmission wire. The reel mechanism is pivotally disposed in the housing and has an accommodating space defined therein for accommodating the speaker. The transmission wire is wound on the reel mechanism. When the transmission wire is pulled or released and thereby drives the reel mechanism to rotate, the speaker rotates coaxially together with the reel mechanism.

20 Claims, 5 Drawing Sheets

EARPHONE

BACKGROUND

1. Field of the Invention

The present invention relates to an earphone, and more particularly, to an earphone having both a speaker and a reel mechanism disposed therein.

2. Description of Related Art

An earphone, when in use, is normally distant from a corresponding electronic device (e.g., a walkman, or a mobile phone). The signal is transmitted between the earphone and the electronic device by a transmission wire or wireless/Bluetooth technology. Relatively, it is simple, cost effective and free of security concerns to use a transmission wire As a result wire transmission technology used in earphones has not yet been replaced by wireless technology, and it has become more and more important to avoid intertwining of transmission wires and ensure convenient winding of transmission wires in today's design of earphones.

Referring to FIG. 1, Taiwan patent 1270310 entitled "Headphone device, electronic apparatus, and cord winding apparatus and cord winding method" discloses an earphone 1. The earphone 1 includes a housing 10, a speaker 20, a reel mechanism 30, and a transmission wire 40. The housing 10 includes a shell 11, a back cover 12, and a front cover 13. The shell 11 has an elastic metal plate 14 and a post 15 formed thereon. The speaker 20 is disposed on a side of the shell 11 facing away from the elastic metal plate 14 and the post 15, and covered by the back cover 12. The speaker 20 is electrically connected with the elastic metal plate 14. The reel mechanism 30 is pivotally mounted on the post 15. The reel mechanism 30 includes a wire holder 31, a spring 32, and a substrate 33. The wire holder 31 is pivotally disposed on the post 15, and defines a ring-shaped wire slot 311 configured for the transmission wire 40 to be wound therein. The spring 32 is arranged on a first side of the wire holder 31, the first side of the wire holder 31 being close to the front cover 13. The spring 32 is configured for restoring the reel mechanism 30 to an initial status after the transmission wire 40 is pulled out. The substrate 33 is disposed on a second side of the wire holder 31. The substrate 33 has a plurality of terminals 331 formed thereon for electrically contacting the elastic metal plate 14.

In the above-mentioned earphone 1, when the transmission wire 40 is pulled out, the reel mechanism 30 rotates at the same time. The terminals 331 are configured for ensuring electrical contact with the elastic metal plate 14 no matter how many turns the wire holder 31 has rotated, so that the speaker 20 can receive audio signals from an electronic device that is electrically connected with the earphone 1. However, in the earphone 1, the speaker 20 and the reel mechanism 30 are respectively disposed on two opposite sides of the shell 11, which not only occupy a relatively large space, but also complicate the design of the shell 11 as well as the assembly of the speaker 20 and the reel mechanism 30. In addition, the elastic metal plate 14 for ensuring electrical contact increases the thickness of the earphone 1. Furthermore, the elastic metal plate 14 may cause bad electrical contact in the event of elastic fatigue.

It is therefore desirable to provide an earphone with simple design and assembly, small dimensions and stable connection between the speaker and the transmission wire.

BRIEF SUMMARY

An earphone according to the present invention includes a housing, a reel mechanism, a speaker, and a transmission wire. The reel mechanism is pivotally disposed in the housing and has an accommodating space defined therein for accommodating the speaker. The transmission wire is wound on the reel mechanism. When the transmission wire is pulled or released and thereby drives the reel mechanism to rotate, the speaker rotates coaxially together with the reel mechanism.

Another earphone according to the present invention includes a housing, a reel mechanism, and a speaker. The reel mechanism is pivotally disposed in the housing. The speaker is disposed in the housing, and engaged with the reel mechanism. The speaker has a transmission wire wound around the speaker. When the transmission wire is pulled or released, the speaker and the reel mechanism are driven to rotate together.

In the above earphone, because the speaker is disposed in the reel mechanism, the space occupied by the speaker and the reel mechanism is reduced. Since the transmission wire is directly drawn from inside of the speaker and wound on the reel mechanism, the conventional contacting elements are eliminated. As a result, the earphone according to the present invention is relatively light.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
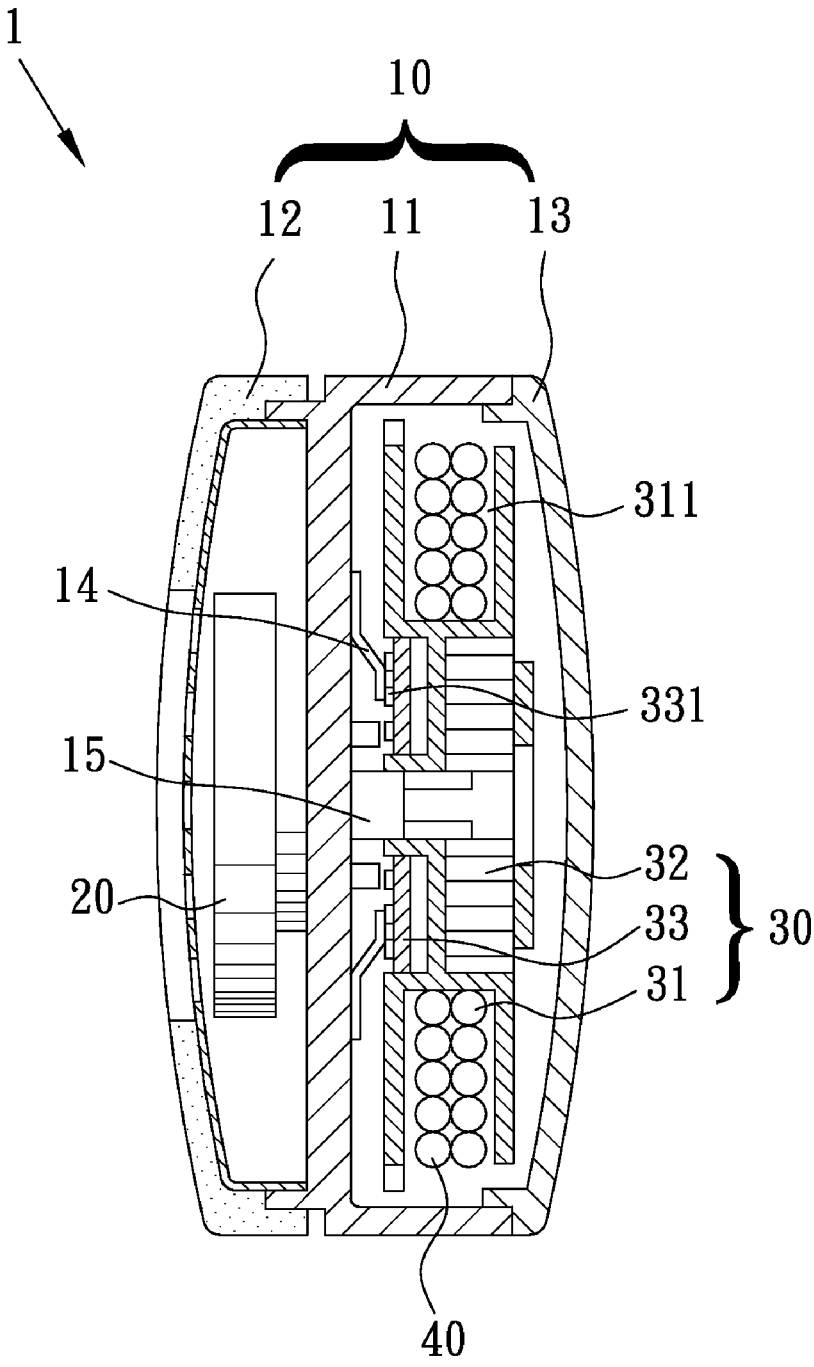
FIG. 1 (prior art)
FIG. 1 is a schematic cross-sectional view of a conventional earphone.
Figure 2:
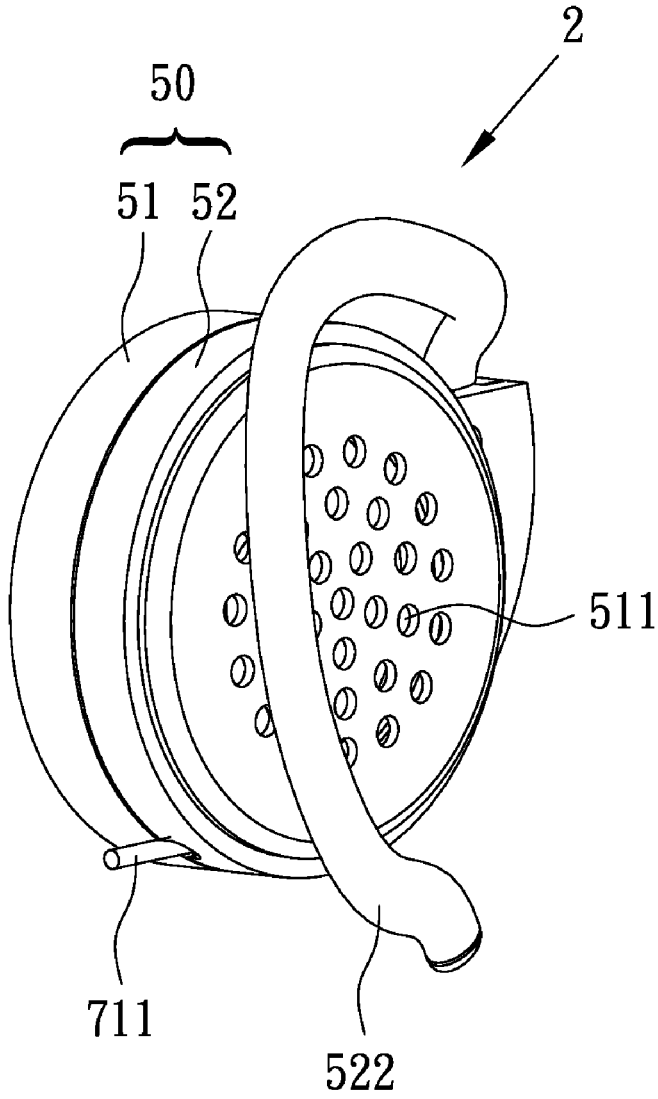
FIG. 2 is a perspective view of an earphone according to an embodiment of the present invention.
Figure 3:
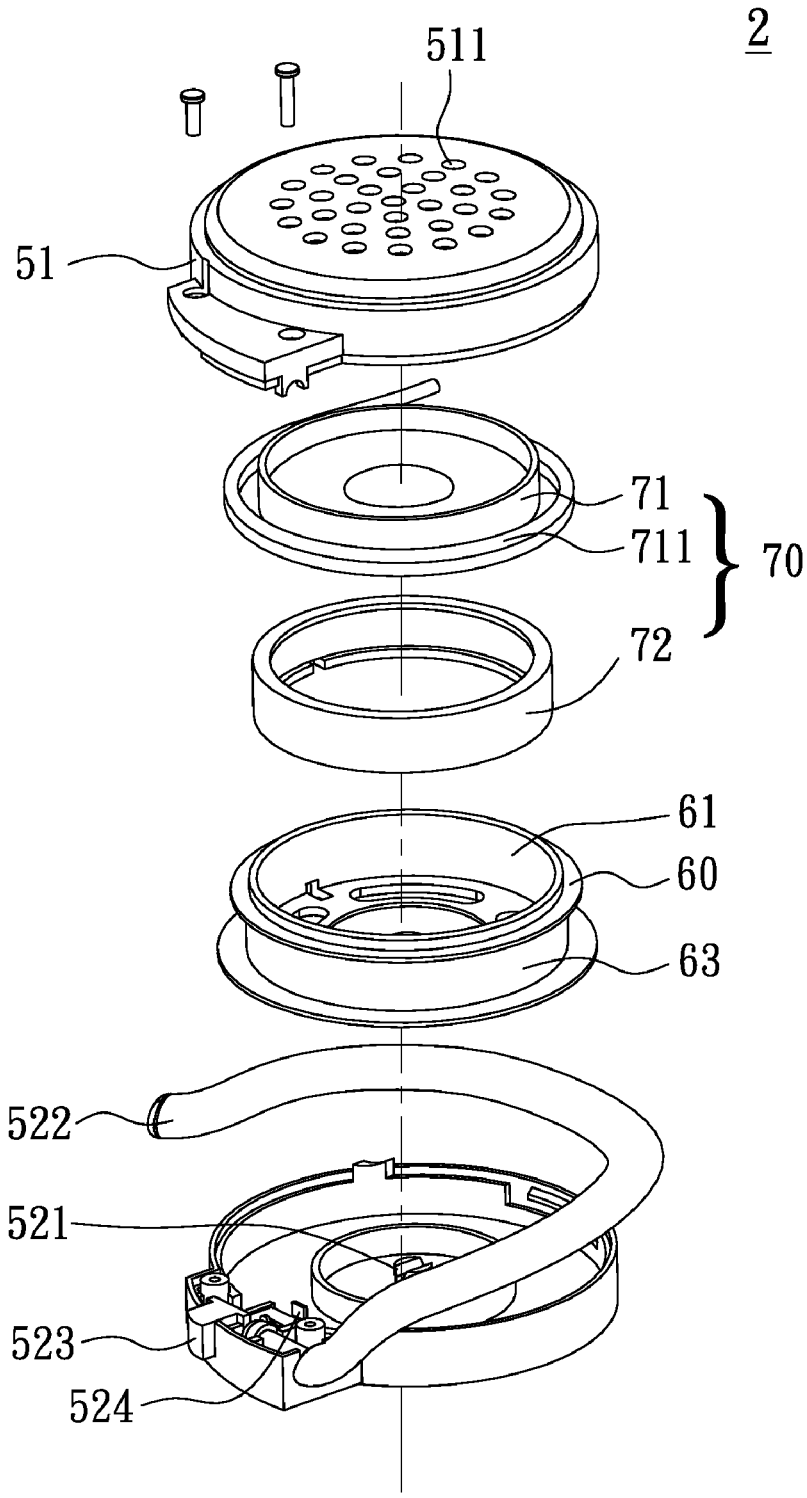
FIG. 3 is an exploded view of the earphone depicted in FIG. 2.
Figure 4:
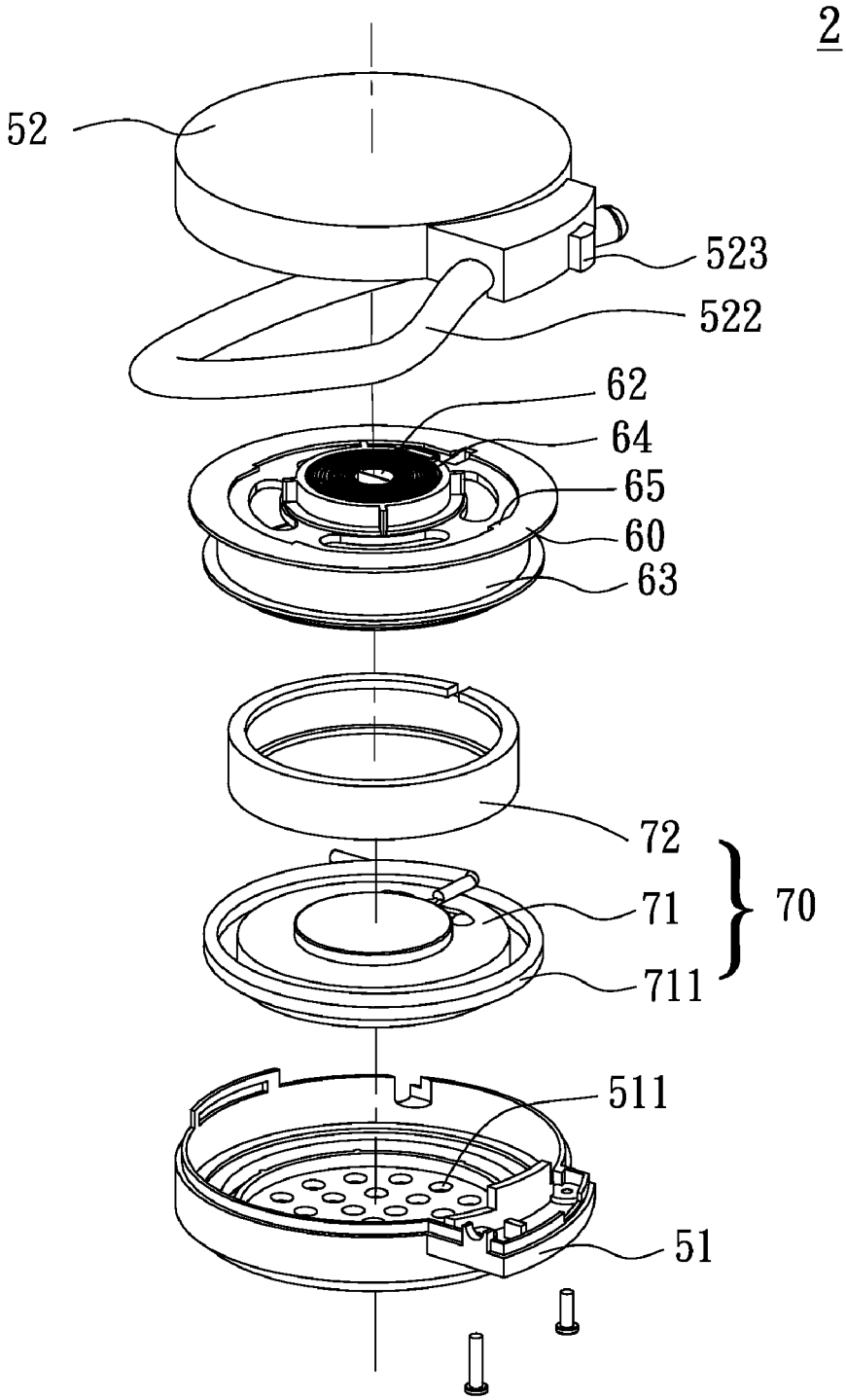
FIG. 4 is another exploded view of the earphone depicted in FIG. 2.

Referring to FIGS. 2-4, a perspective view and two exploded views of an earphone 2 according to a preferred embodiment of the present invention are provided.

The earphone 2 includes a housing 50, a reel mechanism 60, and a speaker 70. The reel mechanism 60 is pivotally disposed in the housing 50. The speaker 70 is engaged with the reel mechanism 60.

Referring to FIGS. 3 and 4, the housing 50 includes a first cover 51 and a second cover 52. The housing 50 is formed by assembling the first cover 51 and the second cover 52 face to face. Both the reel mechanism 60 and the speaker 70 are disposed between the first cover 51 and the second cover 52. The first cover 51 has a plurality of holes 511 for outputting sound produced by the speaker. The second cover 52 has a post 521 formed thereon. The post 521 is configured for pivotally mounting the reel mechanism 60 on the second cover 52. The second cover 52 has an ear hanger 522 at the periphery thereof. The ear hanger 522 is capable of being hung on a user's ear. In addition, the second cover 52 further includes a control switch 523 and a latching element 524. The control switch 523 and the latching element 524 are configured for allowing or blocking the rotation of the reel mechanism 60.

In the present embodiment, the reel mechanism 60 has an accommodating space 61 defined therein. The accommodating space 61 is adapted to accommodate the speaker 70. The reel mechanism 60 has a through hole 62 at a central position thereof for mounting the reel mechanism 60 to the post 521 of the second cover 52. The reel mechanism 60 has a slot 63 defined at the periphery thereof. The reel mechanism 60 further includes a spring 64 at a side thereof facing away from the accommodating space 61. A first end of the spring 64 is securely mounted to the reel mechanism 60, and an opposite second end of the spring 64 is fastened to the housing 50. When the user drives the reel mechanism 60 to be rotated, the spring 64 is stretched, the rotation degrees or the number of rotation circles are controlled by the latching between the latching element 524 and one of a plurality of protrusions 65 of the reel mechanism 60. In order to release the spring 64, the control switch 523 is pressed to push the latching element 524 to be disengaged from the protrusion 65. As a result, the reel mechanism 60 restores to an original state under the elastic restoring force of the spring 64.

In the present embodiment, the speaker 70 includes a main body 71 and a plastic sheath 72. The main body 71 includes a magnetic circuit, a voice coil, a circuit board, and a diaphragm. A transmission wire 711 is connected with the circuit board. During assembly, the main body 71 is first nested in the plastic sheath 72, and then the main body 71 and the plastic sheath 72 are placed into the accommodating space 61 of the reel mechanism 60 together. The transmission wire 711 is wound in the slot 63 of the reel mechanism 60.

It should be noted that the speaker 70 can be secured in the accommodating space 61 of the reel mechanism 60 through latching, gluing, riveting, or bolting engagement. For example, in the preferred embodiment, the size of the accommodating space 61 can be slightly smaller than that of the speaker 70 so that the speaker 70, which is mainly made of plastic, is firmly latched in the accommodating space 61.

Figure 5A:
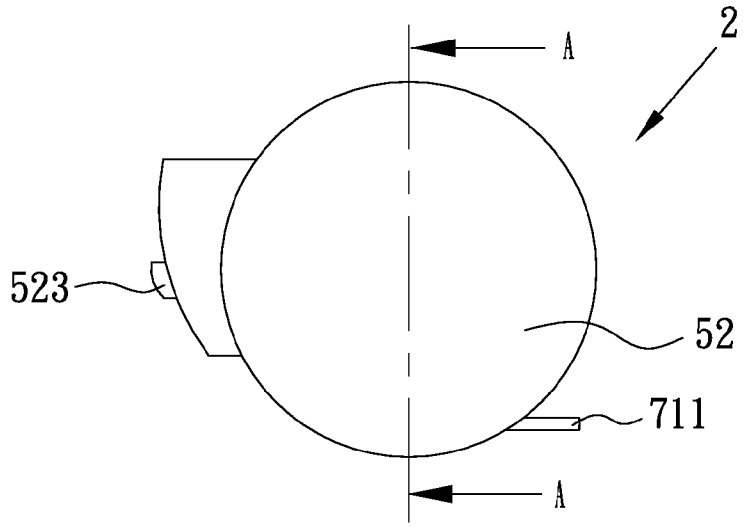
FIG. 5A is a schematic plan view of the earphone depicted in FIG. 2.
Figure 5B:
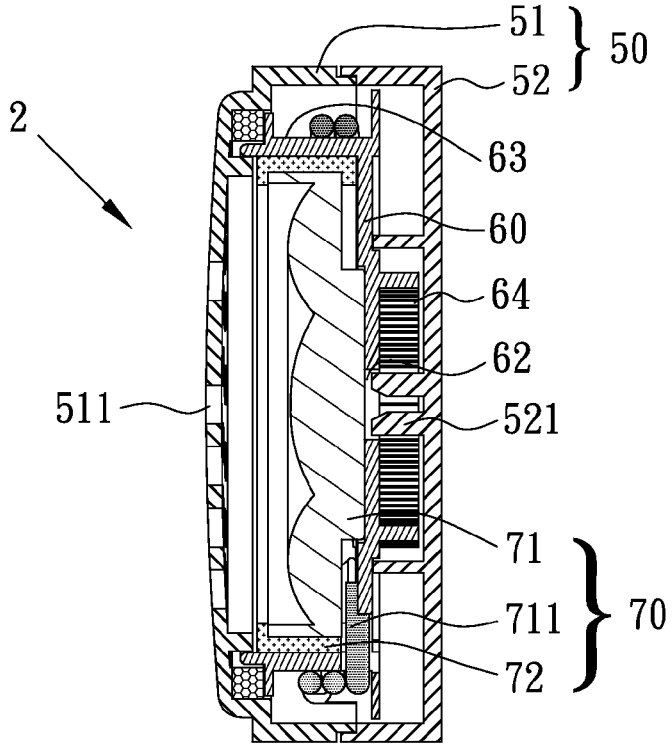
FIG. 5B is across-sectional view of the earphone taken along the line A-A in FIG. 5A.

As shown in FIGS. 5A and 5B, it is noted that the ear hanger 522 is not shown in the figures. Referring to FIG. 5B, in the preferred embodiment, the speaker 70 is completely disposed in the accommodating space 61 of the reel mechanism 60. When the reel mechanism 60 rotates, the speaker 70 is rotated coaxially together with the reel mechanism 60 at the same time. In the preferred embodiment, because the speaker 70 is disposed in the reel mechanism 60, the total volume of the earphone 2 is greatly reduced. Accordingly, the design on the thickness of the housing 50 is more flexible so that a lightweight and thin design can be achieved. In addition, the transmission wire 711 of the speaker 70 is directly connected to the circuit board of the main body 71, and wound in the slot 63 of the reel mechanism 60. As a result, it is not necessary to employ the electrically contacting components (e.g., an elastic metal plate) as in the conventional earphones. Therefore, the number of components used is reduced, and problems such as elastic fatigue and bad contact are avoided.

In another embodiment, the speaker 70 can be tightly attached to the reel mechanism 60 so that the speaker 70 moves with the reel mechanism 60 together, Consequently, the transmission wire 711 is no longer limited to be wound on the reel mechanism 60. No matter the transmission wire 711 is wound on the speaker 70 or on the reel mechanism 60, the speaker 70 can move with the reel mechanism 60 together when the user pulls out or releases the transmission wire 711. In this embodiment the contacting components can also be eliminated.

In the above embodiments, the reel mechanism has an accommodating space for accommodating the speaker therein so that the housing of the earphone is lighter, thinner, and convenient for the user to carry around. Furthermore, the speaker is partially or completely received in the reel mechanism, so that the transmission wire of the speaker can be directly pulled out and wound in the peripheral wire slot of the reel mechanism. Such configuration avoids problems such as bad contact and further achieves lightweight design by eliminating some components.

The foregoing description of the preferred embodiment of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like is not necessary limited the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims.

Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. An earphone comprising:

a housing;

a reel mechanism pivotally disposed in the housing and having an accommodating space defined therein;

a speaker disposed in the accommodating space; and a transmission wire wound on the reel mechanism;

wherein when the transmission wire is pulled or released and thereby drives the reel mechanism to rotate, the speaker rotates coaxially together with the reel mechanism.

2. The earphone of claim 1, wherein the housing is formed by assembling a first cover and a second cover face to face, and the reel mechanism and the speaker are both disposed between the first cover and the second cover.

3. The earphone of claim 2, wherein the first cover has a plurality of holes for outputting sound produced by the speaker.

4. The earphone of claim 2, wherein the second cover has an ear hanger capable of being hung on a user's ear.

5. The earphone of claim 2, wherein the second cover further comprises a control switch configured for allowing or blocking the rotation of the reel mechanism.

6. The earphone of claim 2, wherein the reel mechanism has a through hole formed thereon and the second cover has a post disposed thereon, the post being receivable by the through hole so that the reel mechanism is rotatable to the second cover.

7. The earphone of claim 1, wherein the reel mechanism has a slot for the transmission wire to be wound upon.

8. The earphone of claim 1, wherein the reel mechanism further comprises a spring with a first end secured to the reel mechanism and an opposite second end secured to the housing.

9. The earphone of claim 1, wherein the speaker comprises a main body and a plastic sheath engaged with the main body.

10. The earphone of claim 1, wherein the speaker is secured in the accommodating space through latching engagement, gluing engagement, riveting engagement or bolting engagement.

11. An earphone comprising:

a housing;

a reel mechanism pivotally disposed in the housing; and a speaker disposed in the housing and engaged with the reel mechanism, and having a transmission wire wound around the speaker;

wherein when the transmission wire is pulled or released, the speaker and the reel mechanism are driven to rotate together.

12. The earphone of claim 11, wherein the housing is formed by assembling a first cover and a second cover face to face, and the reel mechanism and the speaker are both disposed between the first cover and the second cover.

13. The earphone of claim 12, wherein the first cover has a plurality of holes defined therein for outputting sound produced by the speaker.

14. The earphone of claim 12, wherein the second cover has an ear hanger capable of being hung on a user's ear.

15. The earphone of claim 12, wherein the second cover further comprises a control switch configured for allowing or blocking the rotation of the reel mechanism.

16. The earphone of claim 12, wherein the reel mechanism has a through hole formed thereon and the second cover has a post disposed thereon, the post being receivable by the through hole so that the reel mechanism is rotatable to the second cover.

17. The earphone of claim 11, wherein the reel mechanism has an accommodating space defined therein and the speaker is disposed in the accommodating space.

18. The earphone of claim 17, wherein the reel mechanism has a slot for the transmission wire to be wound upon.

19. The earphone of claim 11, wherein the speaker is secured in the accommodating space through latching engagement, gluing engagement, riveting engagement or bolting engagement.

20. The earphone of claim 11, wherein the reel mechanism further comprises a spring with a first end secured to the reel mechanism and an opposite second end secured to the housing.

* * * * *